United States Patent [19]

Jokel

[11] Patent Number: 4,680,890

[45] Date of Patent: Jul. 21, 1987

[54] WINDOW INTRUSION BARRIER

[76] Inventor: Isidore Jokel, 4201 Newport "H", Deerfield Beach, Fla. 33441

[21] Appl. No.: 854,428

[22] Filed: Apr. 21, 1986

[51] Int. Cl.[4] ..... E06B 3/68

[52] U.S. Cl. ..... 49/55

[58] Field of Search ..... 49/55, 57, 61, 124

[56] References Cited

U.S. PATENT DOCUMENTS

| | | | |
|---|---|---|---|
| 980,535 | 1/1911 | Kleinegger | 49/57 |
| 1,481,615 | 1/1924 | Meyer | 49/55 X |
| 2,819,500 | 1/1958 | Saber | 49/55 X |
| 3,224,048 | 12/1965 | Sullivan | 49/57 |
| 4,149,342 | 4/1979 | Bowers | 49/55 |
| 4,437,265 | 3/1984 | Turro et al. | 49/57 |

*Primary Examiner*—Philip C. Kannan

*Attorney, Agent, or Firm*—M. K. Silverman

[57] ABSTRACT

A barrier apparatus for the safeguarding of open windows. The apparatus exhibits an adjustable horizontal length adaptable for insertion into a window casement below a framed rectangular window, and slideably positionable within said casement. The barrier apparatus includes two mutually telescoping gridwork panels each constituting rigid rectangular frames adapted to define the panels. Additionally provided are vertically oriented seating posts affixed to upper and lower borders of the frames. Horizontally disposed upon each of the gridwork frames are posts having telescoping co-aligning series of holes such that the geometries thereof are suitable for their interlocking through the use of padlock.

5 Claims, 11 Drawing Figures

WINDOW INTRUSION BARRIER

BACKGROUND OF THE INVENTION

This invention concerns an apparatus for the prevention of unauthorized entry by a person into a building and, more particularly, concerns a barrier apparatus of adjustable dimensions which may be removably inserted into the framework of an open window of a building to prevent passage therethrough.

In residential and industrial buildings, windows capable of opening and closing, and having transparent panels, serve to permit entrance of sunlight and passage of air, and function as emergency exits in case of fire. However, when such windows are open, the security of the building is threatened because of the relative ease with which an intruder may enter through the open window.

Various devices have been disclosed for thwarting unauthorized entrance through an open window while still retaining most of the functionality of the window. Such devices, however, have not heretofore been entirely successful. For complete effectiveness, the barrier device should be capable of easy installation into, and rapid removal from, variously sized window casements while being non-removable by a would-be intruder. The barrier should furthermore provide minimal occlusion of the area it occupies while having sufficient strength to resist forceful breakage.

The pertinent prior art, as best known to the inventor, is reflected in unpatented products known as (1) WIND-O-GUARD, produced by The Leslie Lock Company of Atlanta, Ga. 30339 and (2) BURGLAR BARS, produced by Sterling Hardware Corp. of Richmond, Ill. 60071. The instant invention also represents an improvement over my U.S. Pat. Nos. 4,532,734 and 4,573,285.

SUMMARY OF THE INVENTION

The present invention relates to a barrier apparatus for the safeguarding of open windows, the apparatus having an adjustable horizontal length, and adaptable for insertion into a window casement below a framed rectangular window, slideably positionable within said casement. The barrier apparatus comprises two mutually telescoping gridwork panels each comprising rigid rectangular frames adapted to define a border for and a support of said panels. Further provided are vertically oriented posts affixed to the upper and lower borders of said frames in substantially co-planar disposition with said frames. There are also provided medially disposed horizontal bars within each of two said gridwork panels. Said horizontal bars are provided with extension means having a plurality of apertures therein. When said first and second gridwork panels are telescoped within each other, pairs of said apertures within said horizontal bars will move into positions of alignment. The size of said holes, as well as the distance between said medially disposed horizontal bars exhibit a distal displacement suitable to permit, upon alignment of the apertures thereof, insertion of the shank of a padlock to thereby secure said respective two gridwork panels into a fixed position relative to each other. Various geometries of horizontally disposed telescoping elements provided with holes will be suitable to achieve the objectives of the present invention which, particularly, is to provide an adjustable horizontal window barrier system which can be locked in a selective horizontal degree of extension, thereby permitting usage of such window safeguard barrier on an essentially around-the-clock basis so that removal thereof will not be necessary during evening or night hours.

It is a further object to provide a modified slideably positionable window guard such that the window may be opened to permit passage of air therethrough while preventing the entry of an intruder.

It is another object to provide a barrier apparatus of an adjustable horizontal size capable of facile insertion into the rectangular space of the window casement of an open vertically slideable window.

It is another object to provide a barrier apparatus having the above advantages, that can be readily removed by a user but not readily removed by a would-be intruder.

It is a further object to provide a barrier apparatus of the above nature having durable construction which, nonetheless, may be economically manufactured.

The above and yet other advantages of the present invention will become apparent from the hereinafter set forth Detailed Description of the Invention, the Drawings, and the Claims appended herewith.

DETAILED DESCRIPTION OF THE INVENTION

Figure 1:
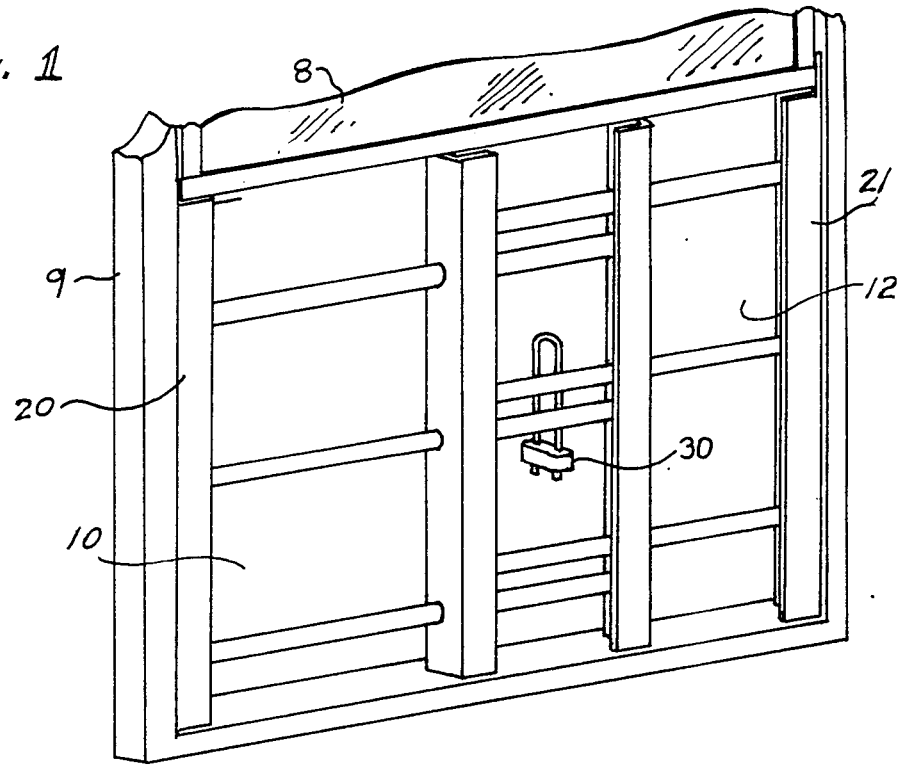
FIG. 1 is a perspective view of a first embodiment of the inventive barrier apparatus.
Figure 2:
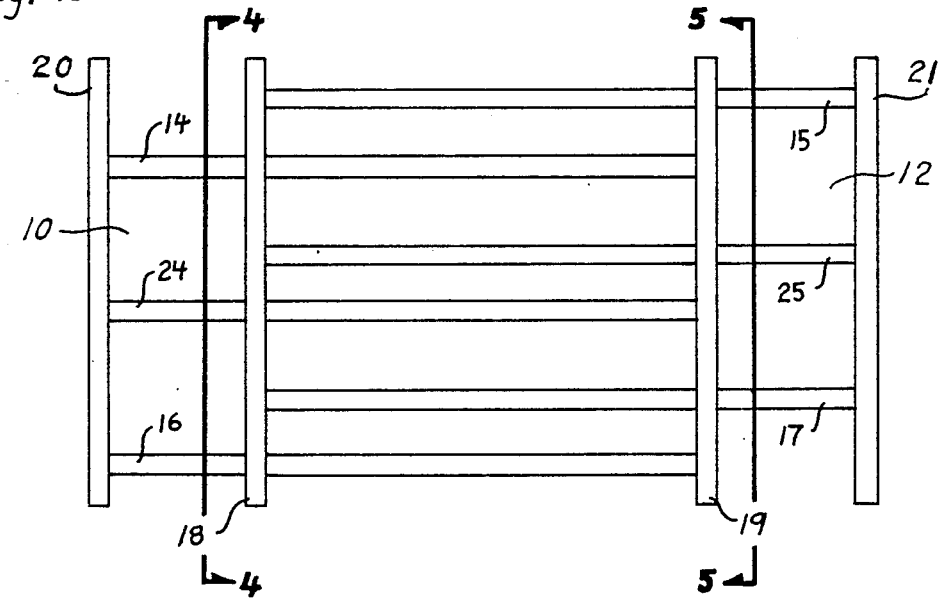
FIG. 2 is a schematic view showing the respective gridwork panels mated with each other.
Figure 3:
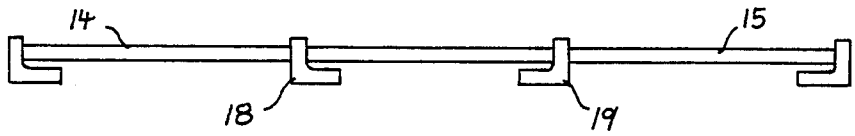
FIG. 3 is a top plan view of FIG. 2.
Figure 4:
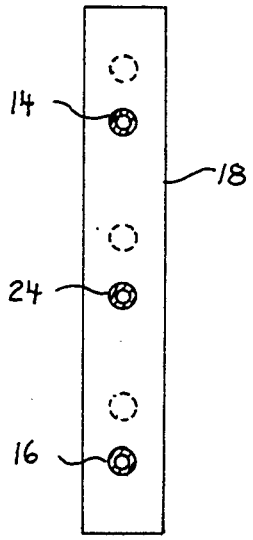
FIG. 4 is a cross-sectional view of FIG. 2 taken along Line 4—4.
Figure 5:
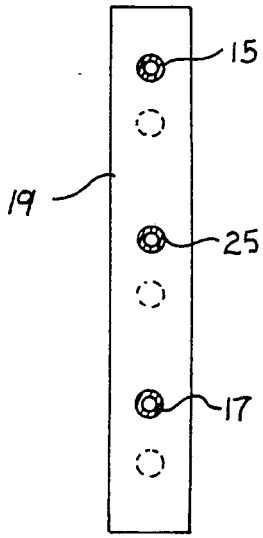
FIG. 5 is a cross-sectional view of FIG. 2 taken along Line 5—5.

With reference to FIGS. 1 and 2, there is shown a first gridwork panel 10 and a second gridwork panel 12. Said panels 10 and 12 are horizontally spaced substantially in co-planar juxtaposition relative to each other. Further, said panels 10 and 12 comprise rigid rectangular frames which border and support said panels. These frames, more particularly, comprise horizontally disposed upper borders 14 and 15 and lower borders 16 and 17. Vertical aspects of each frame comprise inner borders 18 and 19 and outer borders 20 and 21. As may be noted, inner border 18 of the right gridwork panel 12 is oriented as to face opposite to inner panel 19 of left gridwork panel 10. Each of said inner borders 18 and 19 are provided with a plurality of vertically spaced guide apertures (See FIGS. 4 and 5). Said guide apertures permit said upper borders 14 and 15 on the one hand and said lower borders 16 and 17 on the other hand to be telescoped through inner side borders 18 and 19, in the manner shown in FIGS 2, 4 and 5. Also furnished, as a material part of the present invention, are a pair of horizontally directed mating posts 24 and 25 horizontally disposed between the upper and lower borders of each of said gridwork panels 10 and 12. Said mating posts 24 and 25 telescope through said opposing inner borders 18 and 19 in the same manner as said upper borders 14 and 15 on the one hand and said lower borders 16 and 17 on the other hand (See FIGS. 2, 4 and 5).

Figure 6:
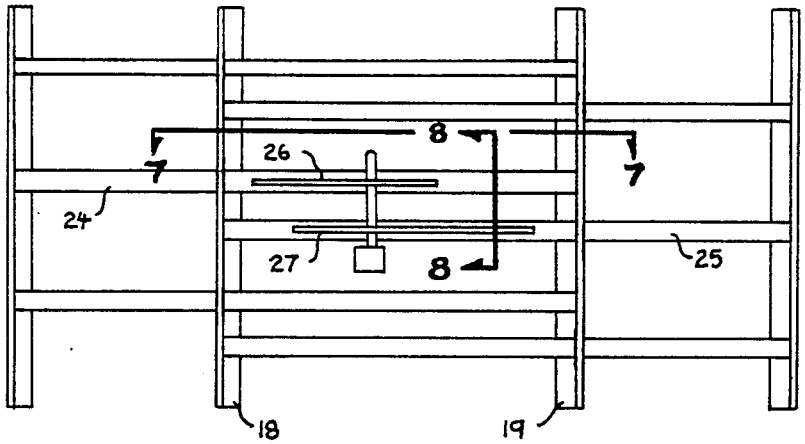
FIG. 6 is a view similar to FIG. 1, showing the addition of horizontal aperture bars.
Figure 7:
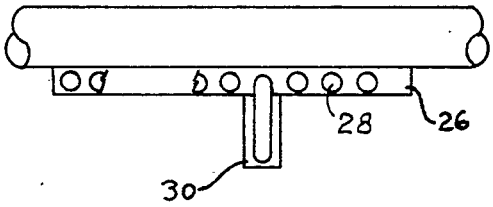
FIG. 7 is a top view of FIG. 6 taken along Line 7—7.
Figure 8:
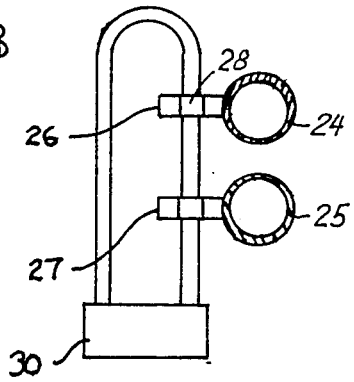
FIG. 8 is a cross-sectional view of FIG. 6 taken along Line 8—8 showing a lock in place.

As is shown in FIGS. 6 thru 8, said horizontally directed mating posts 24 and 25 are each provided with elongate bar-like elements 26 and 27 respectively, each of which include a plurality of apertures 28. The relative vertical distance in between bar-like elements 26 and 27 is such that the apertures 28 thereof may be selectively aligned into any one of a plurality of positions, each position defining a different horizontal length of the present inventive barrier apparatus.

With reference to FIG. 8, it is seen that a desired relative position of said first gridwork panel 10 relative to said second gridwork panel 12 through the placement of the shank of a padlock 30 through a selected pair of apertures 28.

Figure 9:
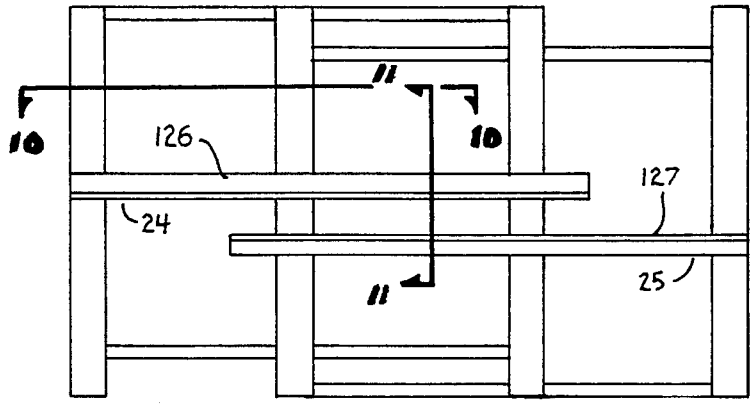
FIG. 9 is a cross-sectional view, similar to the view of FIG. 6, showing a second embodiment of the invention.
Figure 10:
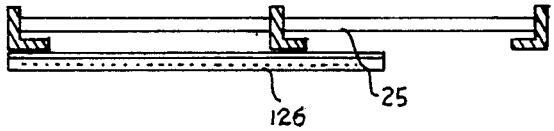
FIG. 10 is a top plan view taken along Line 10—10 of FIG. 9.
Figure 11:
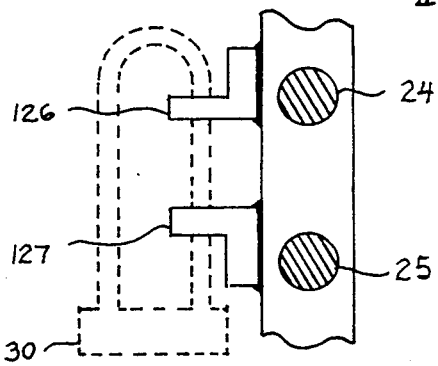
FIG. 11 is a cross-sectional view taken along Line 11—11 of FIG. 9 showing a lock in place.

With reference to FIG. 9 and 10, it is noted that said horizontally directed mating posts may, in an alternative embodiment, include elongate angle irons 126 and 127. In principle, the use of angle irons operates similarly to the use of uni-planar elements 26 and 27 shown in the embodiment of FIGS. 6 to 8. The use of a shank of a padlock to secure such locking in such second embodiment is shown in FIG. 11.

With reference to the views of FIG. 1, there is shown extension elements 32 and 33 placed on top of horizontal outer borders 20 and 21 of the respective gridwork panels 10 and 12. The use of such extension elements is to serve as a wedge between the window casement of the framed horizontal window therewithin. Thereby, the inventive barrier apparatus will be firmly secured relative to both the adjustable window and the horizontal sides of the window casement. Further, the usage of such extension elements 32 and 33 provides a further degree of security against a potential intruder.

While there has been shown and described the preferred embodiment of the present invention, it is to be understood that the invention may be embodied otherwise than is herein specifically illustrated or described and that within said embodiments certain changes in the detail and construction, and the form or arrangement of the parts, may be made without departing from the underlying idea or principles of this invention within the scope of the appended claims.

Having herein described my invention, what I claim as new, useful and non-obvious and, accordingly, secured by Letters Patent of the United States is:

1. A barrier apparatus for a vertically adjustable window, the apparatus having an adjustable length adapted for insertion into a window casement below a framed rectangular window slideably positionable within said casement, said barrier apparatus comprising:

(a) a first and a second gridwork panel horizontally spaced in substantially co-planar juxtaposition, said panels comprising rigid rectangular frames adapted to border and support said panels, each frame comprising horizontally disposed upper and lower borders, and inner and outer vertically oriented side borders, said inner borders facing each other, said facing side borders having vertically spaced guide holes;

(b) first and second horizontally directed posts affixed medially between said upper and lower horizontal borders of each panel, said posts affixed to said facing inner side borders and adapted to slideably penetrate said guide holes;

(c) a first elongate member containing a series of positioning apertures of uniform size, said member integrally secured to one of said horizontal posts;

(d) a second elongate member containing a series of positioning apertures of uniform size, said second member integrally secured to the other of said horizontal mating posts, the vertical distance between said aperture series of said first member and said aperture series of said second member being less than two inches; and (e) locking means for securing said first horizontal post relative to said second post by the placement of said locking means through a co-aligned pair of positioning apertures of said first and second elongate members respectively.

2. The barrier apparatus as recited in claim 1 in which said first and second elongate members further comprise angle irons welded to said vertical side borders.

3. The barrier apparatus as recited in claim 2 in which said locking means comprises a padlock, the shank of which is placed through one of said pairs of co-aligned apertures.

4. The barrier apparatus as recited in claim 1, further comprising an extension arms integrally extending upward from the left-hand border of said first gridwork panel and from the right-hand side panel of said second gridwork panel, said arms adapted to wedge between window casement and the framed horizontal window therewithin, such that said extension elements will secure the barrier apparatus in position within the window casement and relative to the framed rectangular window when closed vertically downward upon the top border of said barrier apparatus.

5. The barrier apparatus as recited in claim 1 in which said locking means comprises a padlock, the shank of which is placed through one of said pairs of co-aligned apertures.

* * * * *